US009021729B2

(12) United States Patent
Moretti

(10) Patent No.: US 9,021,729 B2
(45) Date of Patent: May 5, 2015

(54) RECOIL DAMPING DEVICE FOR PORTABLE FIREARMS

(71) Applicant: Benelli Armi S.p.A., Pesaro Urbino (IT)

(72) Inventor: Luigi Moretti, Collebeato (IT)

(73) Assignee: Benelli Armi S.p.A., Urbino Pu (IT)

( * ) Notice: Subject to any disclaimer, the term of this patent is extended or adjusted under 35 U.S.C. 154(b) by 0 days.

(21) Appl. No.: 14/023,866

(22) Filed: Sep. 11, 2013

(65) Prior Publication Data

US 2014/0075801 A1 Mar. 20, 2014

(30) Foreign Application Priority Data

Sep. 19, 2012 (IT) ..... MI2012A1551

(51) Int. Cl.
*F41C 23/06* (2006.01)
*F41C 23/08* (2006.01)
*F41C 23/18* (2006.01)

(52) U.S. Cl.
CPC ..... *F41C 23/06* (2013.01); *F41C 23/08* (2013.01); *F41C 23/18* (2013.01)

(58) Field of Classification Search
CPC ..... F41C 23/00; F41C 23/04; F41C 23/06; F41C 23/08
USPC ..... 42/1.06, 71.01, 71.02, 72, 73, 74; 89/1.7
See application file for complete search history.

(56) References Cited

U.S. PATENT DOCUMENTS 2,292,351 A * 8/1942 Carpenter et al. ..... 42/71.01
2,455,438 A * 12/1948 Oppold ..... 42/74
2,754,608 A * 7/1956 Stieffel, Jr. ..... 42/74
2,767,500 A 10/1956 Belden
2,791,155 A * 5/1957 Thiel ..... 89/14.3
2,924,904 A * 2/1960 Amsler ..... 42/74
3,001,312 A * 9/1961 Campbell ..... 42/74
3,209,482 A * 10/1965 Kuzma et al. ..... 42/74
3,491,473 A * 1/1970 Eastin ..... 42/74
3,696,544 A 10/1972 Webb
4,439,943 A * 4/1984 Brakhage ..... 42/74
4,663,877 A * 5/1987 Bragg ..... 42/74
5,375,360 A * 12/1994 Vatterott ..... 42/74
5,471,776 A * 12/1995 Chesnut et al. ..... 42/74

(Continued)

FOREIGN PATENT DOCUMENTS

DE 456 074 C 2/1928
DE 23 05 562 A1 5/1974

(Continued)

OTHER PUBLICATIONS

Lee Spring, LeeP Plastic Composite Springs, Jan. 21, 2010, http://www.leespring.com/int_learn_LeeP.asp.*

*Primary Examiner* — Bret Hayes
*Assistant Examiner* — Derrick Morgan
(74) *Attorney, Agent, or Firm* — R. Neil Sudol; Henry D. Coleman

(57) ABSTRACT

A recoil damping device for portable firearms, including a casing in which a recoil damping means is inserted; the damping means includes a fixed part, which is integral with the casing, and a movable part able to slide along a substantially axial direction inside the casing; the damping means is made of a material having a certain elastic hysteresis and includes a set of flexible members connecting the fixed part to the movable part; the flexible members have different stiffnesses.

8 Claims, 9 Drawing Sheets

(56) References Cited

U.S. PATENT DOCUMENTS

| | | | | |
|---|---|---|---|---|
| 6,684,547 | B2 * | 2/2004 | Poff, Jr. | 42/1.06 |
| 6,834,455 | B2 * | 12/2004 | Burigana | 42/74 |
| 7,121,032 | B2 * | 10/2006 | Daul et al. | 42/1.06 |
| 7,124,529 | B1 * | 10/2006 | Havelka, Jr. | 42/74 |
| 7,926,216 | B2 * | 4/2011 | Bentley | 42/1.06 |
| 8,176,668 | B2 * | 5/2012 | Simms et al. | 42/1.06 |
| 2003/0154640 | A1 * | 8/2003 | Bragg | 42/74 |
| 2006/0096148 | A1 * | 5/2006 | Beretta | 42/74 |
| 2007/0175077 | A1 * | 8/2007 | Laney et al. | 42/74 |
| 2010/0122482 | A1 * | 5/2010 | Simms et al. | 42/1.06 |
| 2011/0302817 | A1 * | 12/2011 | deBrun et al. | 42/74 |
| 2012/0167432 | A1 * | 7/2012 | Howe et al. | 42/74 |
| 2013/0145668 | A1 * | 6/2013 | Valin | 42/74 |
| 2014/0109452 | A1 * | 4/2014 | Baker | 42/1.06 |

FOREIGN PATENT DOCUMENTS

| | | |
|---|---|---|
| EP | 1657518 | 5/2006 |
| EP | 1348928 | 5/2011 |
| GB | 2371104 | 7/2002 |

* cited by examiner

RECOIL DAMPING DEVICE FOR PORTABLE FIREARMS

BACKGROUND OF THE INVENTION

The present invention relates to a recoil damping device for portable firearms.

As is known, the stock of rifles has the purpose of fixing the distance between the shooter's shoulder and the trigger, of taking part in defining the center of gravity of the firearm and of distributing the pressure generated by the recoil force over a larger surface, so as to reduce the unit value and transmit it to the shooter's shoulder.

In order to reduce the dynamic load on the shoulder, caused by the recoil of the firearm, or to improve its ballistic characteristics, numerous devices have been proposed, including accessories to be applied to the stock and internal mechanisms of various kinds.

Damping systems are known, for example, that are constituted by an elastic portion formed in the rear part of the stock and adapted to partially absorb the recoil energy by deforming.

An important drawback of that type of system is that the elastic portion deforms, during the recoil step, and easily causes lateral shifting in the rearward motion of the rifle. Therefore, the motion of the recoiling firearm does not follow the longitudinal axis thereof but is diverted, with consequent loss of the aiming line and of the correct firearm placement by the shooter.

Another conventional damping system is substantially constituted by a butt plate that is mounted on the stock of the rifle, by interposing damping means generally constituted by helical springs.

GB2371104 and EP1657518 disclose systems of that type.

Namely, EP 1657518 discloses a recoil damping device that includes an insert, arranged in the stock of a rifle, and a damping means constituted by helical springs and dampers. Such device includes a movable interface that retains the damping means and is provided with stems that can slide within guides provided in the insert. The movable interface is made of plastic material that is adapted to deform, when needed, during recoil, in order to keep the rifle true, ensuring at the same time the coaxial arrangement of the stems that slide within the guides.

The damping device known from EP1657518 is effective in damping the recoil force and reduces the shifting of the rifle during shooting, without amplifying the negative effects of an incorrect firearm placement. However, such system is constructively complicated and therefore productively expensive and relatively heavy.

U.S. Pat. No. 7,926,216 discloses a damping device constituted by a piston that is integral with the butt and is adapted to move in a seat in the stock of the firearm, in contrast with a helical spring, which works by traction by virtue of a lever system. The system described in U.S. Pat. No. 7,926,216 is constructively complicated and heavy.

U.S. Pat. No. 6,684,547 discloses a recoil damping system constituted by a set of elastic members that are interposed with rigid members that are mounted on a stem that can slide between the stock of the firearm and the frame.

Another type of damping system, used in long firearms, is constituted by a stock that includes cavities provided in the comb of the stock and filled with material adapted to absorb energy.

EP1348928 describes a stock of such type, which reduces the dynamic load on the shooter's shoulder, caused by the recoil of the firearm, at the same time allowing to improve the ballistic behavior of the firearm, reducing barrel rise at the muzzle, at the moment of firing, with consequent speed of target acquisition for shots after the first one.

The damping system described in EP1348928 allows a reduction in the dynamic load caused by recoil, which is particularly advantageous in the case of use of high-pressure and high-weight cartridges.

U.S. Pat. No. 2,767,500 discloses a shock absorption mechanism having an elliptical spring and a cylinder filled with hydraulic fluid.

DE2305562 discloses a shoulder pad provided with shock absorber means constituted by rubber pins of different length and elasticity.

In general, the above described prior art systems, based on mechanisms that are internal to the stock, have the drawback of being structurally complicated and therefore expensive.

The accessories to be applied to the stock can have a lower cost but do not offer optimal functional characteristics.

Also, in the prior art systems, the behavior of the elastic means is linear, i.e., the flexibility of the helical springs and of the other elastic members used is approximately constant. In practice, the deformation of the elastic members is directly proportional to the applied compression force, thus generating a linear chart on the Cartesian plane. This entails that the damping system is effective for a narrow range of munitions. In practice, the system works well only for certain munitions but is far less effective for more powerful or weaker munitions.

In other words, in the case of much more powerful munitions, the traditional damper deforms excessively and fully collapses, transmitting a considerable impact force to the shooter's shoulder. In the case of much weaker munitions, instead, the system does not deform sufficiently and does not reduce the effects of recoil.

OBJECTS OF THE INVENTION

The aim of the present invention is to provide a recoil damping device for portable firearms that overcomes the drawbacks of the cited prior art.

Within the scope of this aim, an object of the invention is to provide a damping device that has an optimum operation for a wide range of munitions, from the weakest to the most powerful ones.

Another object of the invention is to provide a damping device that is constructively simple, is constituted by a reduced number of components and is lightweight and economical from a production standpoint.

Another object is to provide a damping device that can be installed easily in a traditional stock made of wood or synthetic material.

SUMMARY OF THE INVENTION

This aim and these and other objects that will become better apparent hereinafter are achieved by a recoil damping device for firearms, comprising a casing in which a recoil damping means is inserted; said damping means comprising a fixed part and a movable part, said fixed part being substantially integral with said casing, said movable part being able to slide in a substantially axial direction inside said casing; said damping means being made of a material having an elastic hysteresis and comprises a set of flexible members connecting said fixed part to said movable part; said flexible members having different stiffnesses.

BRIEF DESCRIPTION OF THE DRAWINGS

Further characteristics and advantages will become better apparent from the description of preferred but not exclusive embodiments of the invention, illustrated by way of non-limiting example in the accompanying drawings, wherein.

DETAILED DESCRIPTION

Figure 1:
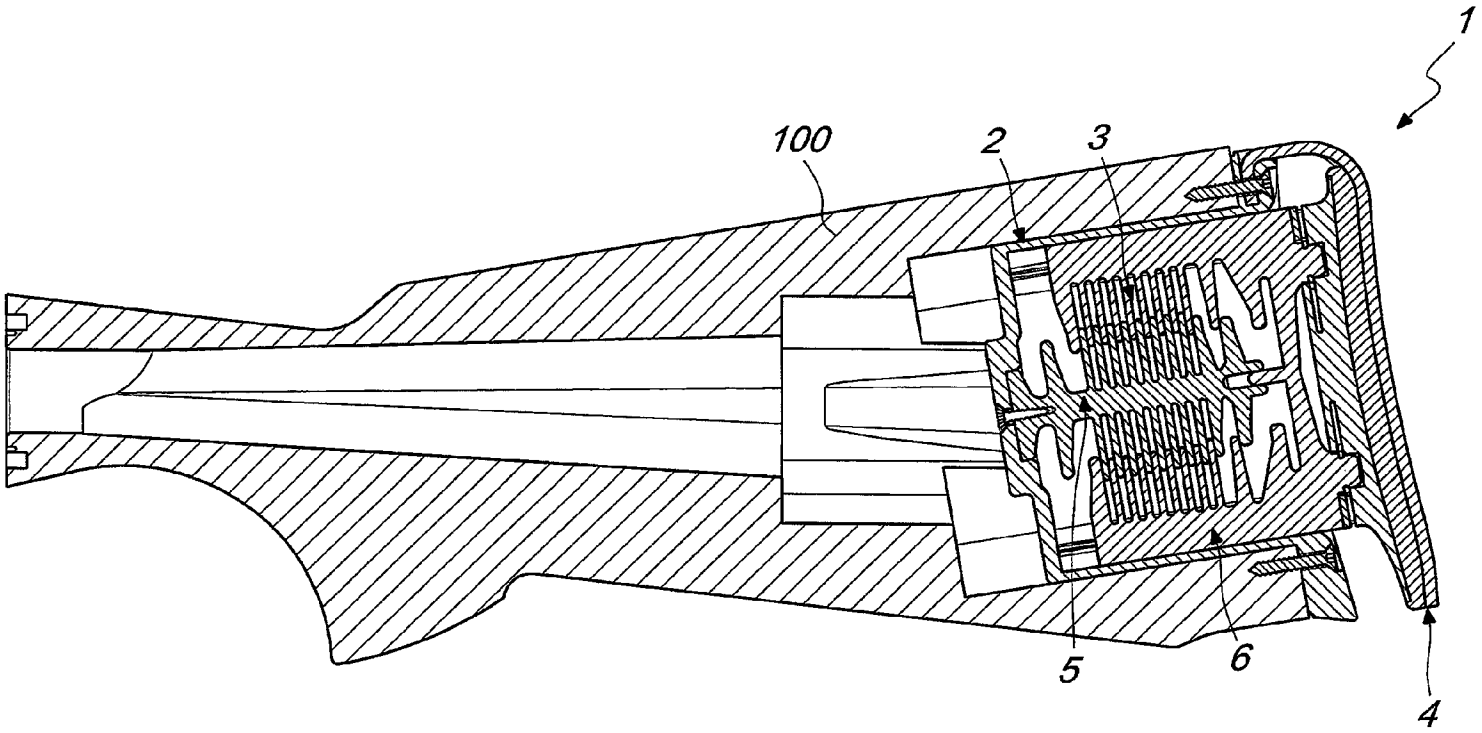
FIG. 1 is a longitudinal sectional view of a stock of a firearm, particularly of a rifle, provided with the device according to the present invention.
Figure 2:
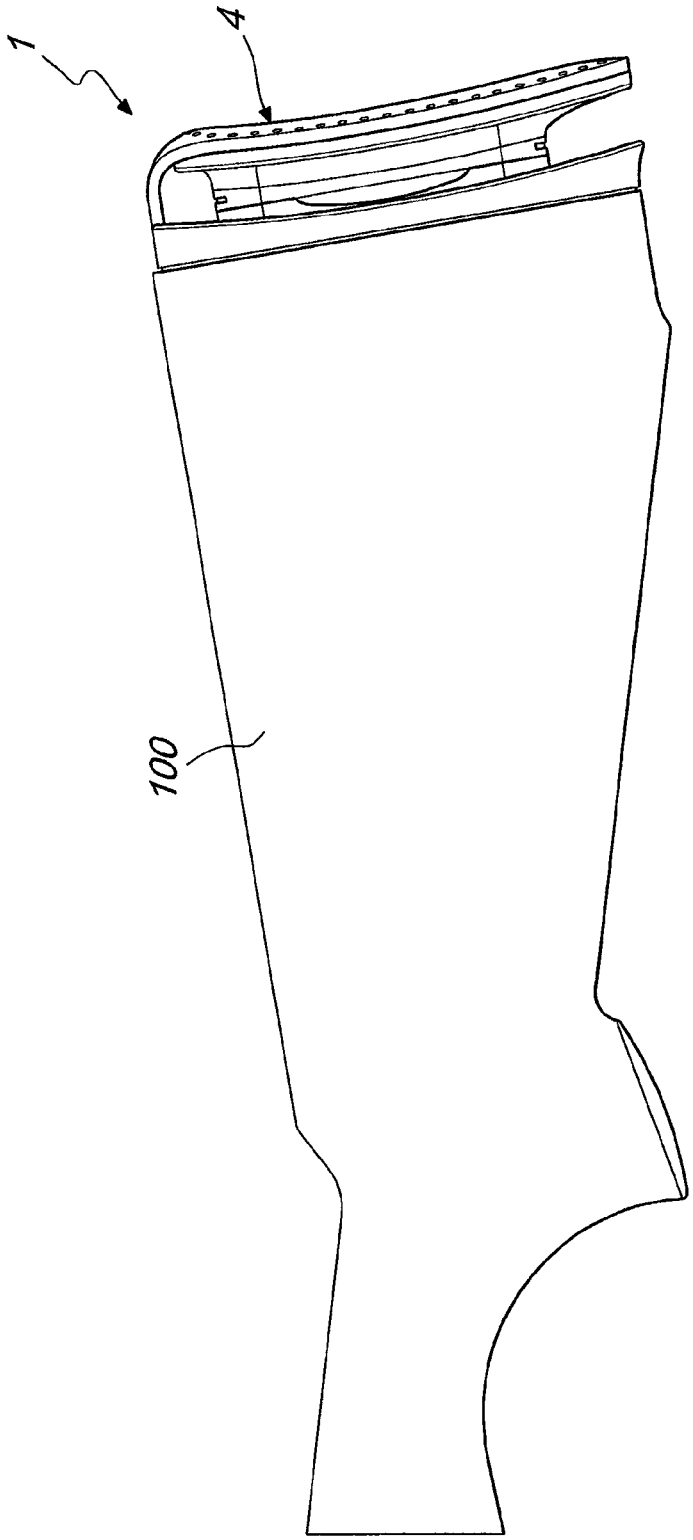
FIG. 2 is a side view of the stock of the preceding figure, provided with the device according to the present invention.
Figure 3:
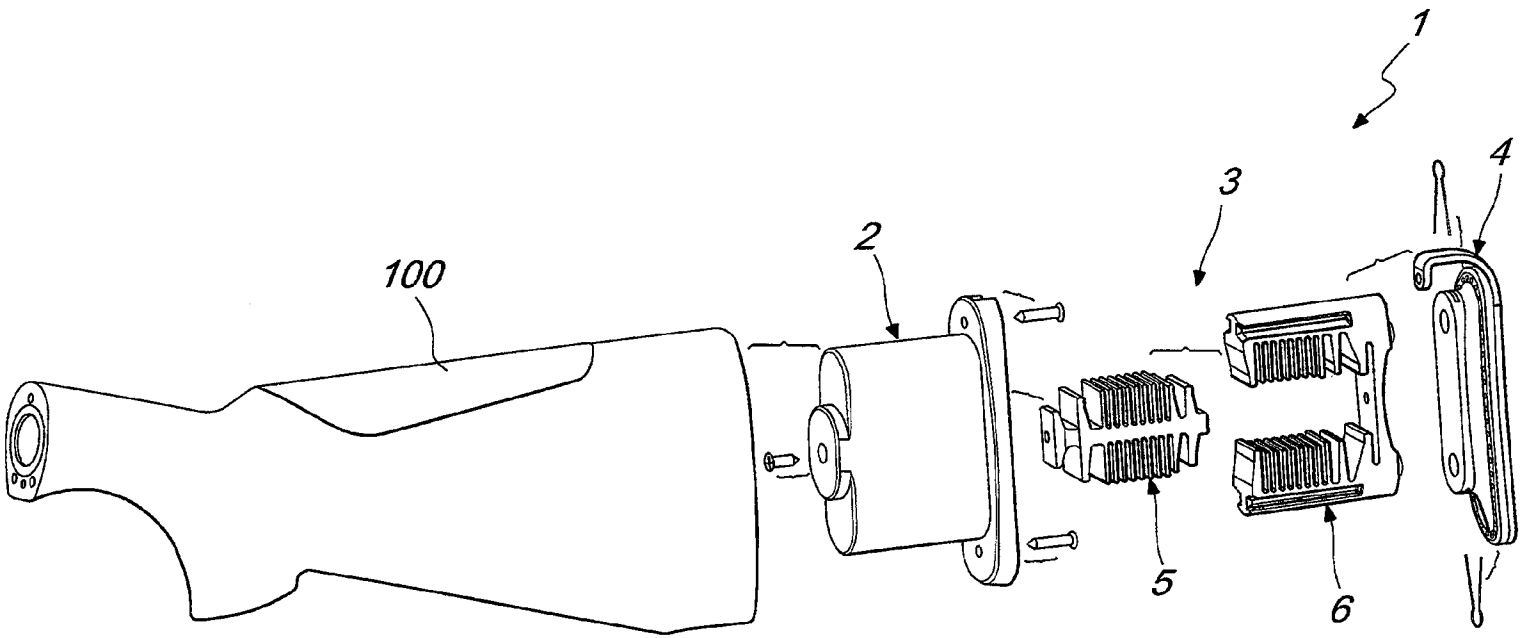
FIG. 3 is a perspective exploded view of the stock of the preceding figure, showing the device according to the present invention.
Figure 4:
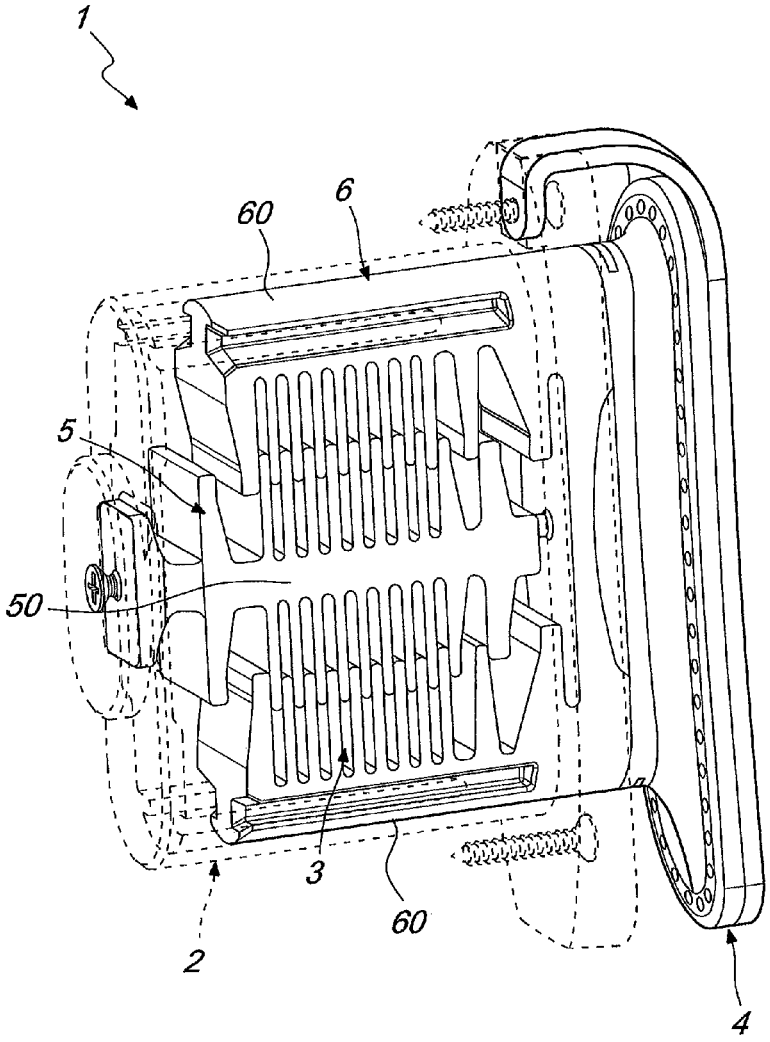
FIG. 4 is a perspective view, partially in phantom lines, of the device.

With reference to the cited figures, the device according to the invention, generally designated by the reference numeral 1, is arranged in a stock 100 of a firearm, such as, for example, a rifle.

The device 1 has a casing 2 that has a substantially oval cross-section and in which a damping means 3 is inserted.

The casing 2 can be an independent member, as in the illustrated example, or can be constituted by a seat provided in the stock of the firearm.

The device 1 includes furthermore a butt plate 4, which is functionally associated with the damping means 3 and is arranged outside the casing 2 and the stock 100.

The damping means 3 has a fixed part 5 and a movable part 6.

The fixed part 5 is substantially integral with the casing 2, and therefore with the stock 100 of the firearm, while the movable part 6 slides, along a substantially axial direction, within the casing 2.

The butt plate 4 is integral with the movable part 6 and therefore is movable with respect to the stock 100.

The movement of the butt plate 4 is therefore damped by the damping means 3, that absorbs the energy of the recoil generated by firing.

The damping means 3 is advantageously constituted by a material that has a desired elastic hysteresis, for example a synthetic resin.

The damping means 3 includes a set of flexible members that connect the fixed part 5 to the movable part 6.

Advantageously, the flexible members have different stiffness, obtained by means of variations in geometry and/or materials.

In this embodiment, the fixed part 5 is connected to the movable part 6 by means of a set of members arranged transversely to the direction of motion of the movable part.

The fixed part 5 has an axial core 50 provided with a first set of fixed blades 71, at least one second set of fixed blades 72, a third set of fixed blades 73 and a fourth set of fixed blades 74.

In the embodiment illustrated herein, the second set of fixed blades 72 is constituted by a plurality of fixed blades, while the first, third and fourth set are all constituted by a single pair of fixed blades.

The term "fixed blade" here refers to a blade that is associated with the fixed part 5.

The movable part 6 includes two arms 60 joined by a bridge 65.

Each arm 60 supports a first set of movable blades 61, a second set of movable blades 62, a third set of movable blades 63, and a fourth set of movable blades 64.

The term "movable blade" here refers to a blade that is associated with the movable part 6.

Figure 5:
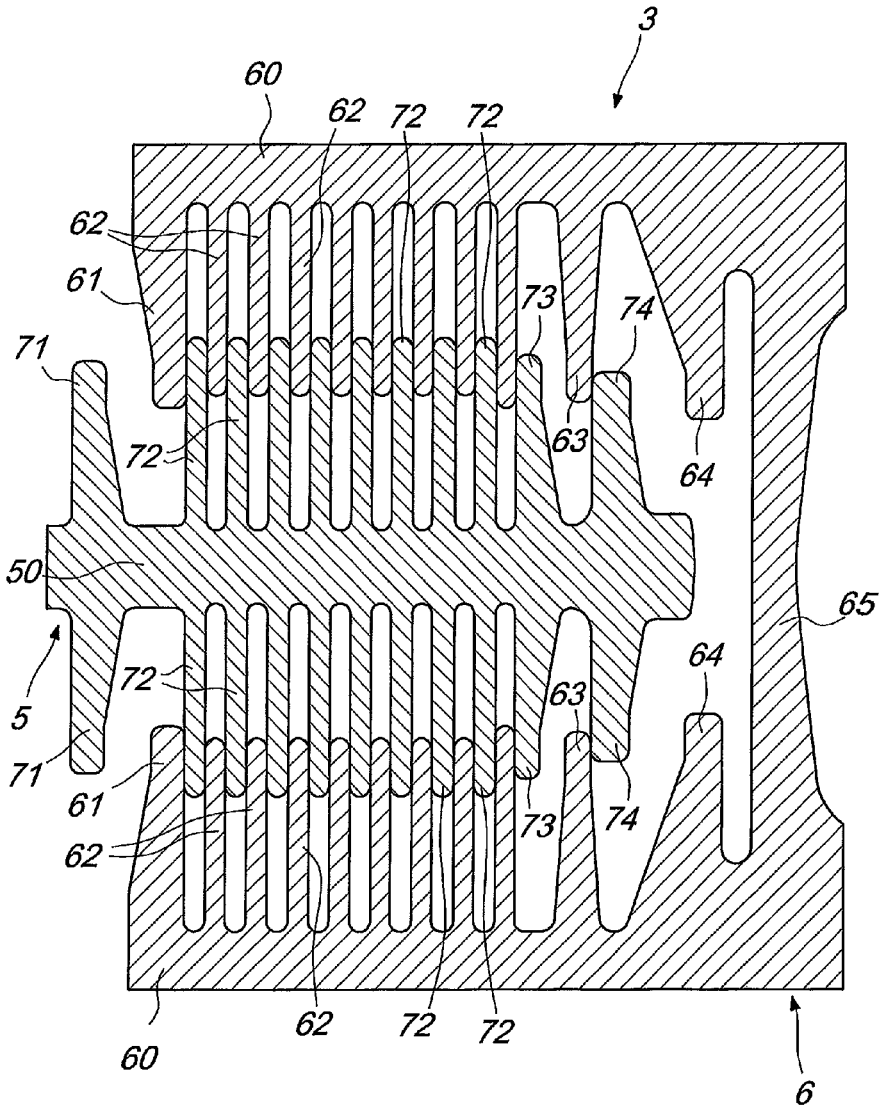
FIG. 5 is a side view, taken along a longitudinally sectional plane, of the damping means of the device in the rest position.

The operation of the damping means 3 is shown in FIGS. 5-9, that show the mutual movement of the fixed part 5 and of the movable part 6 starting from a rest position visible in FIG. 5.

At firing, the recoil of the firearm moves the fixed part 5, which is integral with the stock 100, with respect to the movable part 6, which is rested against the shooter's shoulder at the butt plate 4. With reference to FIGS. 5-9, the fixed part 5 moves to the right with respect to the movable part 6.

In the first movement step, the recoil energy causes the deformation of the second sets of movable blades 62 and fixed blades 72, which are the ones with the lowest stiffness.

Figure 6:
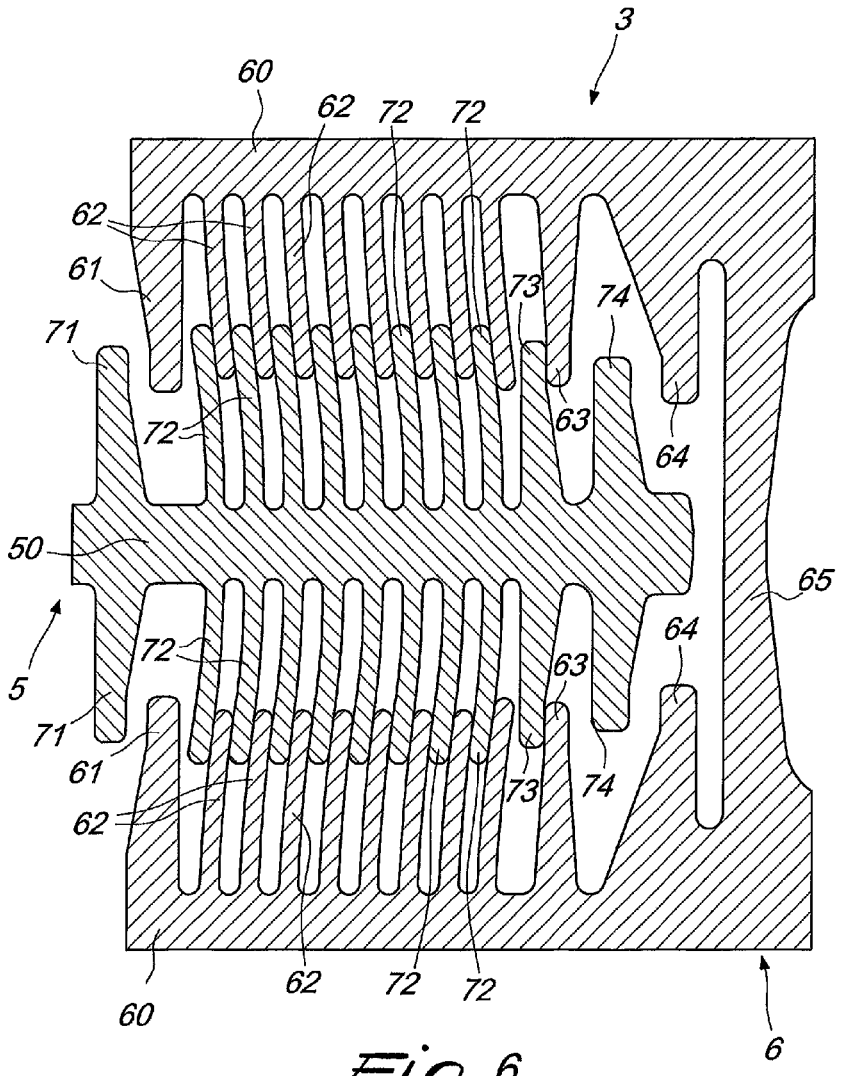
FIG. 6 is a view, similar to the preceding one, of the damping means in a first step of deformation.

The second sets of blades, 62 and 72, flex and slide with respect to each other, as can be seen in FIG. 6, absorbing the recoil energy.

Figure 7:
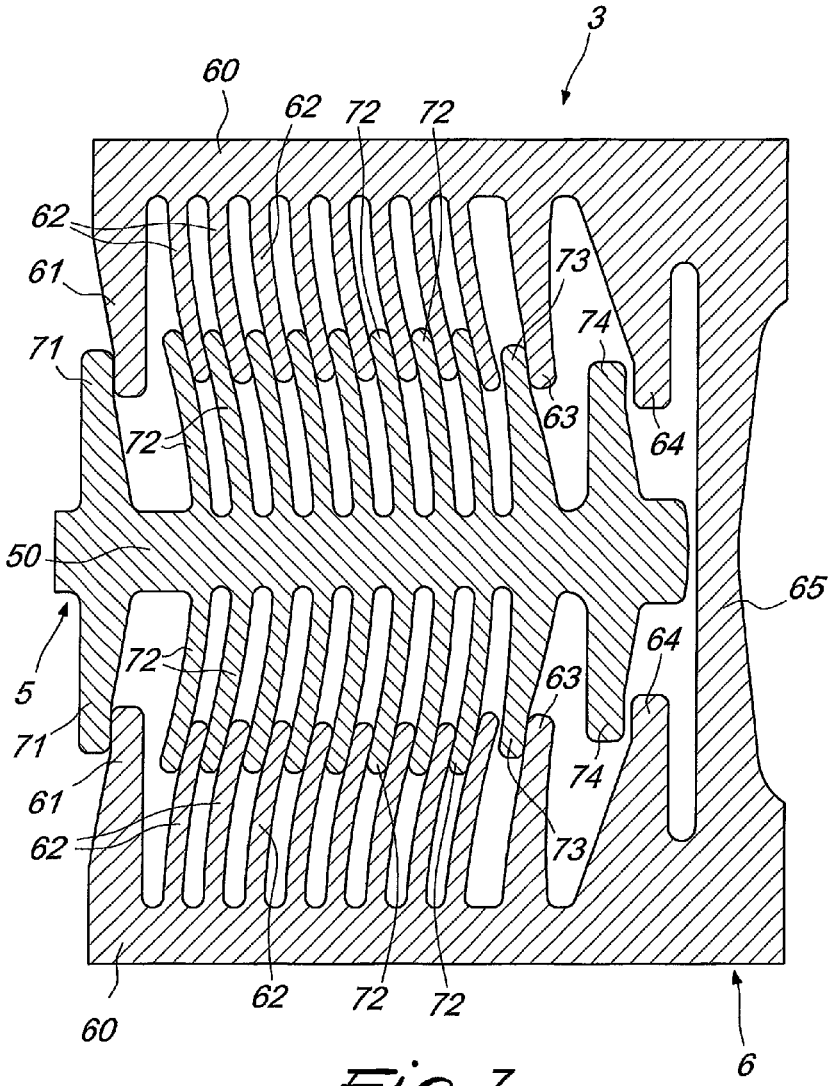
FIG. 7 is a view, similar to the preceding one, of the damping means in a subsequent deformation step.

If the recoil energy is low, only the second sets of blades are involved in the movement of the parts; if instead the energy of the recoil is greater, the movement of the fixed part 5 with respect to the movable part 6 also involves the third sets of blades 63 and 73, as can be seen in FIG. 7.

These third sets of blades 63 and 73 have a higher stiffness than the second sets 62 and 72 and absorb the higher recoil energy that is not absorbed by the second sets of blades.

FIG. 7 also illustrates the first set of blades 71, of the fixed part 5, that comes into contact with the first set of blades 61 of the movable part 6.

Figure 8:
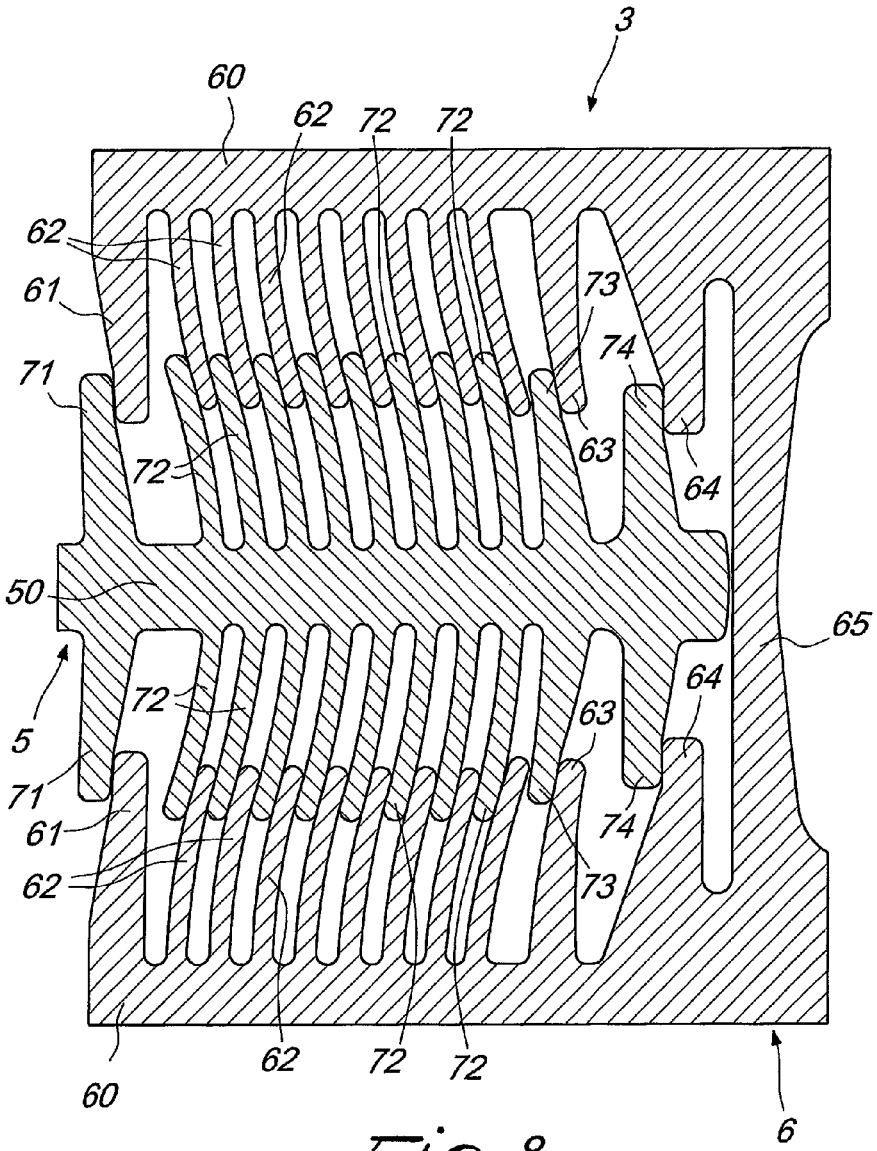
FIG. 8 is a view, similar to the preceding one, of the damping means in a further step of deformation.

If the recoil energy has not yet been absorbed, the movement of the fixed part 5 with respect to the movable part 6 moves the first set of fixed blades 71, together with the fourth set of fixed blades 74, to interact respectively with the first set of movable blades 61 and with the fourth set of movable blades 64, as shown in FIG. 8.

The deformation of the first and fourth sets of blades 61, 64 and 71, 74 allows to absorb the residual energy of the recoil.

The first and fourth sets of blades 61, 71, 64 and 74 have a higher stiffness than the third sets 63 and 73 and absorb the residual energy of the recoil that is not absorbed by the third set of blades.

Figure 9:
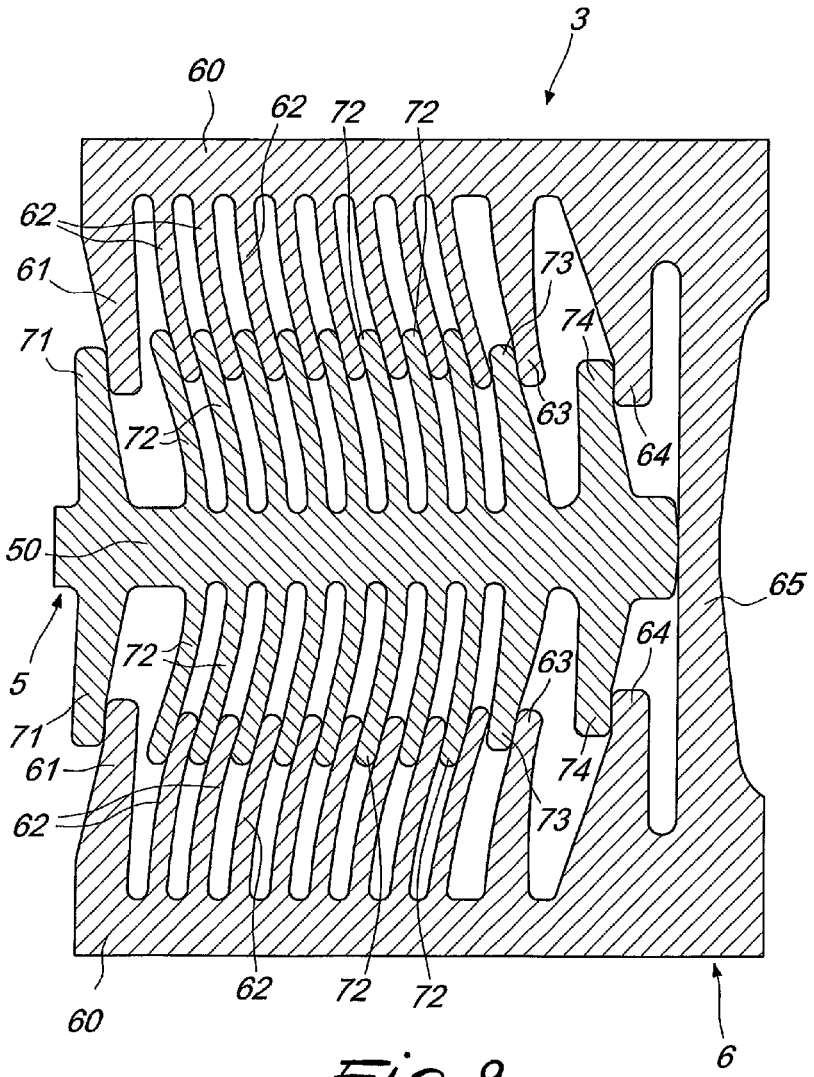
FIG. 9 is a view, similar to the preceding one, of the damping means in the maximum deformation position.

FIG. 9 shows the stroke end position of the damping means 3, in which the axial core 50 of the fixed part 5 comes into contact with the bridge 65 of the movable part 6, ending the stroke of the fixed part 5 with respect to the movable part 6.

The bridge 65 too is susceptible of an elastic deformation and therefore allows to absorb additional energy, preventing the reaching of the stroke end from being detectable by the user.

In the embodiment exemplified here, the various sets of blades are configured to give the damping means at least three distinct stiffnesses, constituted in increasing order of the second sets of blades 62, 72, by the third sets of blades 63, 73 and by the first and fourth sets of blades 61, 71, 64, 74.

The intervention of the various elastic members is continuous and progressive, by virtue of the particular shape of the blades, that flex and slide over each other during the motion of the fixed part with respect to the movable part.

The stiffnesses of the blades are appropriately selected in order to cover, with a single device, a vast range of munitions and in practice all commercially available munitions.

However, the damping means 3 can be realized in various manners, increasing or decreasing the differentiations of the various elastic members in order to increase or reduce the range of elastic behavior and to vary it.

The damping means 3 can in fact be easily replaced by the user, simply by removing the butt plate 4 and extracting the assembly 3, constituted by the fixed part and the movable part, in order to replace it with another assembly with a different performance.

Since the device 1 is contained in the casing 2, the body is easily inserted in a stock 100, prepared beforehand with an adapted seat.

Ease of production is combined with the advantage of being able to cut the stock easily to reduce its length and apply again the device 1 at the end of the stock, exactly as on the original stock.

The advantages of the device according to the present invention with respect to the prior art systems are multiple and important.

First of all, the present device is the only one that offers optimum performance for a wide range of munitions, contrary to the prior art devices.

In fact, differently from traditional damping systems, that have elastic means with a linear behavior, i.e., undergo a deformation that is directly proportional to the force of the recoil, the elastic means of the present invention offers a differentiated flexibility, i.e., a reduced resistance to small compressions, which however increases exponentially as the deformation increases, tracing on a chart on Cartesian axes, with compression on the X-axis and force on the Y-axis, a curve of an exponential type.

Another advantage of the present invention is constituted by the reduced weight of the device with respect to, for example, systems with helical springs and dampers.

The particular shape of the elastic means, constituted by blades made of a material that has elastic hysteresis, in fact prevents an elastic oscillation of the system.

A further advantage of the present invention resides in that the device can be mounted equally on traditional stocks made of wood, without altering their aesthetics, and on stocks made of synthetic resin, with or without the casing.

The casing can in fact be constituted by the seat itself provided in the stock.

This application claims the priority of Italian Patent Application No. MI2012A001551 filed on Sep. 19, 2012, the subject matter of which is incorporated herein by reference.

The invention claimed is:

1. A recoil damping device for firearms, comprising a casing in which a recoil damping means is inserted; said damping means comprising a fixed part and a movable part, said fixed part being substantially integral with said casing, said movable part being able to slide along a substantially axial direction inside said casing; said damping means being made of a material having an elastic hysteresis and comprising a set of flexible members in the form of blades connecting said fixed part to said movable part; said blades being arranged transversely to the direction of movement of said movable part, at least two of said blades having mutually different stiffnesses.

2. The damping device according to claim 1, wherein said damping means is made of a synthetic resin.

3. The damping device according to claim 1, wherein said fixed part comprises an axial core provided with a first set of fixed blades, at least one second set of fixed blades, a third set of fixed blades and a fourth set of fixed blades; said movable part comprises two arms joined by a bridge; each of said arms supports a first set of movable blades, a second set of movable blades, a third set of movable blades and a fourth set of movable blades.

4. The damping device according to claim 3, wherein said movable part undergoes an axial movement with respect to said fixed part owing to a force generated by the recoil of the firearm upon firing, from a rest position to a stroke end position; in a first step of said movement, said recoil force causes a deformation of said second set of movable and fixed blades; said second set of blades flex and slide with respect to each other; if said recoil force has not been exhausted, a successive step of said movement causes the deformation also of said third set of blades; said third set of blades have a greater stiffness than said second set of blades; if said recoil force has not been exhausted, a successive step of said movement causes the deformation also of said first set of blades and said fourth set of blades; said first and fourth set of blades have a greater stiffness than said third set of blades.

5. The damping device according to claim 3, wherein said bridge of said movable part can deform elastically due to the action of said axial core of said fixed part due to movement caused by a residual recoil force.

6. The damping device according to claim 1, comprising a butt plate, functionally associated with said damping means and arranged outside said casing.

7. The damping device according to claim 1, comprising a seat formed in a stock of a firearm and adapted to accommodate said casing.

8. The damping device according to claim 1, wherein said blades include first blades attached to said fixed part and second blades attached to said movable part, said first blades and said second blades being interleaved with one another.

* * * * *